US008448819B2

(12) United States Patent
Pirrie et al.

(10) Patent No.: US 8,448,819 B2
(45) Date of Patent: May 28, 2013

(54) DISPENSER SYSTEM

(75) Inventors: Alastair Bruce Pirrie, Oxford (GB); David Waterman, Oxford (GB)

(73) Assignee: Atrium Innovation Limited, London (GB)

( * ) Notice: Subject to any disclaimer, the term of this patent is extended or adjusted under 35 U.S.C. 154(b) by 1244 days.

(21) Appl. No.: 11/814,130

(22) PCT Filed: Jan. 17, 2006

(86) PCT No.: PCT/GB2006/000137

§ 371 (c)(1), (2), (4) Date: Mar. 3, 2008

(87) PCT Pub. No.: WO2006/077389

PCT Pub. Date: Jul. 27, 2006

(65) Prior Publication Data

US 2008/0277415 A1 Nov. 13, 2008

(30) Foreign Application Priority Data

Jan. 18, 2005 (GB) ..... 0501015.2

(51) Int. Cl.
*B67D 1/00* (2006.01)

(52) U.S. Cl.
USPC ..... 222/88; 222/83; 138/42

(58) Field of Classification Search
USPC ..... 222/83, 88; 138/42, 115, 116; 239/49, 239/46, 15, 50; 220/374
See application file for complete search history.

(56) References Cited

U.S. PATENT DOCUMENTS

| | | | | |
|---|---|---|---|---|
| 2,453,080 | A * | 11/1948 | Shimp | 222/185.1 |
| 3,092,106 | A * | 6/1963 | Butler | 604/251 |
| 3,729,142 | A * | 4/1973 | Rangel-Garza et al. | 239/542 |
| 5,971,215 | A | 10/1999 | Bartsch et al. | |
| 6,328,543 | B1 * | 12/2001 | Benecke | 417/411 |
| 6,626,332 | B2 * | 9/2003 | Ehrensperger et al. | 222/190 |
| 6,772,911 | B2 * | 8/2004 | Gee et al. | 222/83 |
| 2003/0197025 | A1 | 10/2003 | Cabarroque et al. | |
| 2005/0051572 | A1 * | 3/2005 | Vogel et al. | 222/83 |

FOREIGN PATENT DOCUMENTS

| | | | |
|---|---|---|---|
| FR | WO03039877 | A2 * | 5/2003 |
| WO | WO-03/000431 | | 1/2003 |

* cited by examiner

*Primary Examiner* — Len Tran
*Assistant Examiner* — Viet Le
(74) *Attorney, Agent, or Firm* — Ted Sabety, Esq.

(57) ABSTRACT

A dispenser system comprising a reservoir, a closure device for controlling the flow of liquid from the reservoir, and a housing to which the reservoir is attached is disclosed. The reservoir is movable relative to the housing from a storage position in which the closure device prevents liquid flowing from the reservoir to a dispensing position in which the closure device allows liquid to flow from the reservoir. The housing comprises an activation device which on movement of the reservoir from the storage position to the dispensing position causes the closure device to allow the liquid to flow from the reservoir.

33 Claims, 10 Drawing Sheets

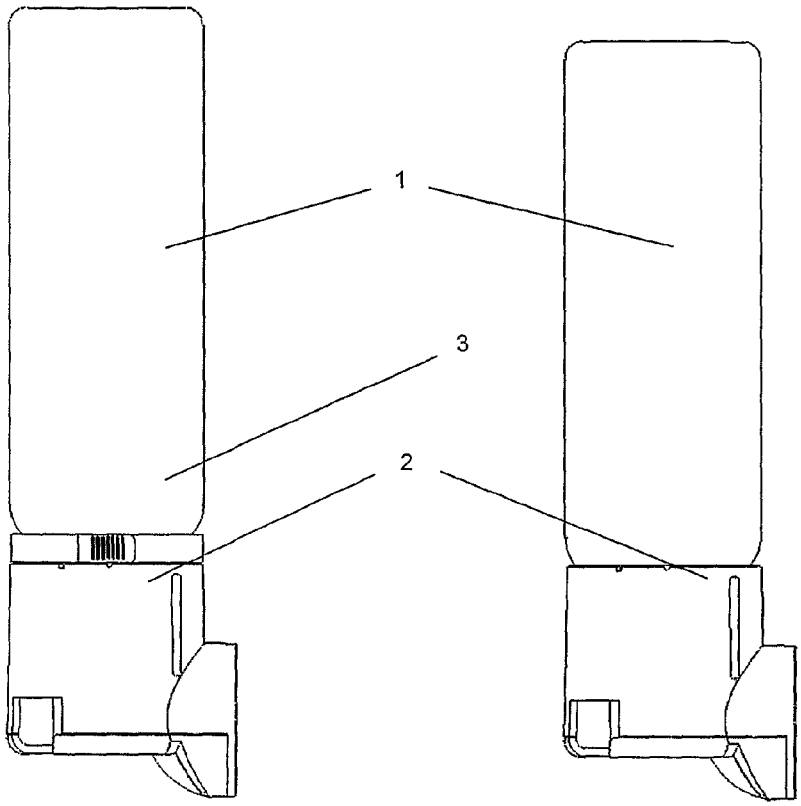
Figure 6a
Figure 6b
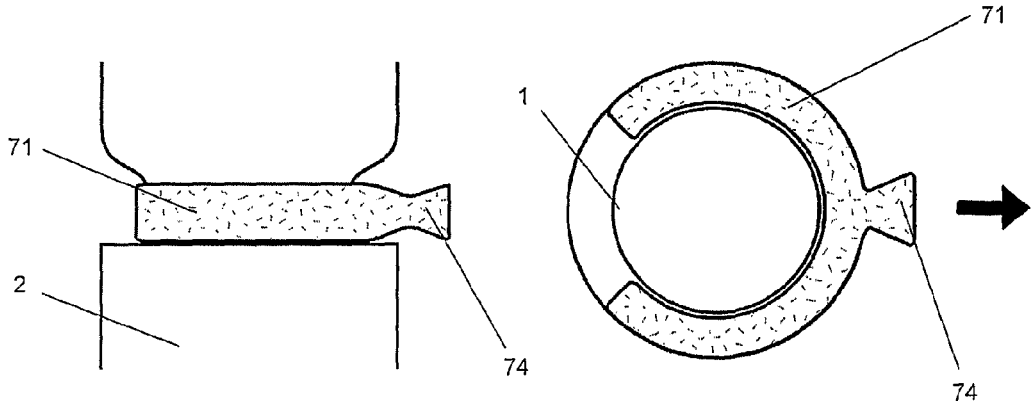
Figure 7a
Figure 7b

DISPENSER SYSTEM

This invention relates to a dispenser system for use in delivery of a liquid from a fixed volume reservoir under a constant pressure head by displacement of liquid in the reservoir by air. Such a dispenser, for use in an electrostatic spray system, is described in PCT/GB02/02900, which describes an inverted, rigid reservoir holding liquid for dispensing and into which air is fed as liquid is drawn off in use.

Similar dispenser systems might also be required in an industrial printing process where ink must be delivered under a constant pressure, for example. There are many other applications with similar requirements, and these would all benefit from the present invention.

One problem with traditional designs of rigid reservoir, constant head dispenser systems is that liquid may for a variety of reasons creep out of the air inlet channel. This could occur, for example, if the dispenser is vibrated by machinery in which it is fitted, or if the reservoir heats up, or if it is removed and left on its side or upside down. In any of these situations the liquid expelled is free to escape, and this may be undesirable due to its properties. For example, an ink might create unwanted stains or an oil might harm users or cause contamination of the local environment.

In any case the prevention of such leaks is highly desirable, and the prevention of such leaks is not straightforward, especially when the reservoir contains a large quantity of liquid that might escape. In some circumstances, the escape of the liquid could be extremely annoying or dangerous.

Prior art dispenser systems also suffer from premature or undesired release of fluid from the reservoir caused, for example, by damage in transit or storage or unintended activation of the dispenser. In addition, changes in ambient conditions, removal of the dispenser after activation, or operation or storage after activation in unusual orientations can cause leakage of liquid via air inlet paths of prior art dispenser systems.

In accordance with one aspect of the present invention, there is provided a dispenser system comprising a reservoir, a closure device for controlling the flow of liquid from the reservoir, and a housing to which the reservoir is attached, the reservoir being movable relative to the housing from a storage position in which the closure device prevents liquid flowing from the reservoir to a dispensing position in which the closure device allows liquid to flow from the reservoir, wherein the housing comprises an activation device which on movement of the reservoir from the storage position to the dispensing position causes the closure device to allow the liquid to flow from the reservoir.

Hence, the invention provides a dispenser system which is only capable of releasing liquid from the reservoir once it has been activated by relative motion of the reservoir and housing. The provision of the housing encloses and protects the closure device and helps to prevent premature rupturing or opening of this.

The reservoir is typically rigid so that it maintains its volume as the liquid is displaced by air. However, it may be flexible provided the air or other gas or liquid or mechanism displacing the liquid to be dispensed is at a higher pressure than the atmospheric pressure in which the reservoir is situated.

In one embodiment, the reservoir is rotationally movable relative to the housing from the storage position to the dispensing position. In another embodiment, the reservoir is linearly movable relative to the housing from the storage position to the dispensing position.

The closure device may be a membrane that is ruptured by the activation device when the reservoir is moved to the dispensing position, thereby allowing liquid to flow from the reservoir. The membrane may be a metal foil, and this can be heat welded across an open end of the reservoir.

Alternatively, the closure device may be a valve that is opened by the activation device when the reservoir is moved to the dispensing position, thereby allowing liquid to flow from the reservoir. In this case, the closure device is not permanently opened when the reservoir is moved to the dispensing position. Therefore, movement of the reservoir from the dispensing position to the storage position may cause the valve to close, thereby preventing liquid from flowing from the reservoir.

The closure device ensures that the liquid is retained in the reservoir even under moderate pressure. The liquid may be retained within the reservoir for a very long period of time without being effected by temperature or orientation of the dispenser, and so provides a useful extension of shelf life for the dispenser prior to use.

The closure device prevents loss of liquid by leakage or evaporation until final use (i.e. the closure device is caused to allow liquid to flow from the reservoir). Thus during manufacture, storage and delivery, which could be a period lasting for many years, the liquid is retained within the reservoir.

It is intended that the reservoir will typically be firmly retained by the housing so that the two cannot become separated and expose the closure device. For example, a collar on the reservoir may engage with a projection on an interior wall of the housing that is shaped such that the collar may be pushed past the projection for assembly, but cannot then be, subsequently withdrawn without destroying the housing or reservoir. Such a mechanism provides an easy way to assemble and form an integrated unit.

Preferably, the dispenser system further comprises a removable activation inhibitor which prevents the reservoir being moved from the storage position to the dispensing position. This provides an extra safeguard against premature activation of the dispenser, which could otherwise be caused by undesired relative motion between the reservoir and housing. Effectively, the activation inhibitor provides a mechanical obstruction against accidental activation of the dispenser.

In one embodiment, the activation inhibitor is attached to the housing by way of one or more anchor sections that yield when the activation inhibitor is pulled from the housing. In this case, the activation inhibitor is typically integrally moulded with the housing.

The activation inhibitor may be a plastic strip disposed between the reservoir and housing. A benefit of this type of activation inhibitor is that it provides a useful means of detecting whether the dispenser has ever been used.

The activation inhibitor may be replaceable after it has been removed from the housing. This is particularly useful when the closure device is a valve and movement of the reservoir back to the storage position causes the valve to close because the activation inhibitor may then be replaced preventing further undesired activation of the dispenser. One type of replaceable activation inhibitor is a flexible clip that is disposed between the reservoir and the housing.

When the reservoir is linearly movable relative to the housing then the activation inhibitor prevents the linear motion by being disposed between the reservoir and housing. Thus, the relative linear motion can only occur after the activation inhibitor has been removed. When the reservoir is rotationally movable relative to the housing then activation inhibitor may be adapted to engage with an asperity on either the reservoir or housing, thereby blocking the passage of the asperity and preventing relative motion of the housing and reservoir.

In a preferred embodiment, the housing further comprises an air inlet channel through which air can flow from one or more inlet ports on the exterior of the housing to one or more outlet ports within the housing so as to displace any liquid that flows from the reservoir. This allows the path taken by the air to displace the liquid in the reservoir to be carefully controlled, which is useful in preventing leaks after activation.

The provision of an air inlet port ensures that the liquid in the reservoir (which could be a large volume, for example more than 5 ml) is delivered at a constant head of pressure to the outlet or extraction port. Furthermore, the air inlet port allows the contact of the liquid with the air to be minimised under normal use, so that whatever is being dispensed is less affected by evaporation or oxidation, for example.

The air inlet channel in the region of the inlet port (or indeed the inlet port itself) may be of capillary dimension. This prevents liquid running out of the dispenser due to the orientation of the dispenser because air will not be able to enter the air inlet channel past the liquid, and therefore no liquid will come out. At this point the only way to cause liquid leakage would be to heat the dispenser up or to move it into a lower pressure environment.

If the air inlet channel is of capillary dimension at least along a part of its length then liquid will never leak if the dispenser system is turned upside down or laid on its side even if air expansion in the rigid reservoir displaces liquid from it, such as might occur when the temperature rises or the dispenser is moved to a higher altitude. Typically, the air inlet channel splits into a number of sets of one or more parallel spiral conduits arranged around the periphery of the housing.

Dividing the air inlet channel into a set of parallel conduits helps to prevent leakage if the dispenser is ever laid on its side or in another unusual orientation. If only a single, unbroken air channel is used and liquid happens to cover the internal end of that channel and air in the reservoir expands (for example, due to a rise in temperature a reduction in ambient pressure, such as may occur in the cabin of an aircraft), then liquid would inevitably and undesirably be forced out of the dispenser. Using a plurality of separate channels minimises the risk of this occurring.

Arranging the sets of parallel conduits in a spiral configuration ensures that should air in the dispenser expand (for example, due to a rise in temperature a reduction in ambient pressure, such as may occur in the cabin of an aircraft) when the dispenser is left in an unusual attitude then liquid in contact with any conduit must be forced over the highest point in the dispenser. It is therefore more likely that air will instead pass though a channel which does not communicate directly with the liquid. In this sense air is allowed to pass in and out of the dispenser and the dispenser can be said to be able to 'breathe'. The number of conduits in a set is not critical, but the number and their relative positions should be chosen such that in whatever position the dispenser lies the internal openings of one of the spirals is likely not to be covered by liquid. This is most likely if the spirals are arranged symmetrically around their common axis and if there are three or more.

Preferably, each adjacent set of parallel spiral conduits are arranged around the housing in opposing senses. This arrangement of opposing parallel spiral conduits ensures that, if the dispenser is rolled, liquid is only likely to pass through one set of the spirals, but not the other.

Each set of parallel spiral conduits typically comprises n conduits, and each of the n conduits may be disposed so as to be rotationally symmetrical about their common axis, normally the longitudinal axis of the housing, and to extend between the ends of an arc of $180\times(2n-1)/n$ degrees. If each spiral rotates by at least $180\times(2n-1)/n$ degrees (where n is the number of separate spirals) around their common axis (normally the longitudinal axis of the housing) then the spiral whose internal end is at the lowest point (prior to all internal points being immersed) travels over the highest point of the dispenser when it is on its side.

Preferably, each set of parallel spiral conduits converges into a single, mutual channel which itself splits into the adjacent set of parallel spiral conduits. This ensures that if a small amount of liquid does somehow make its way into all three of the spiral channels, it will be collected in the intermediate single, mutual channel and so is much less likely to pass through the next set of spirals. In effect, the relatively large volume of the mutual channel acts as a buffer reservoir mitigating onward migration of any liquid.

Each set of parallel spiral conduits may be formed between an interior wall of the housing and an insert fixed to the housing which defines the path of parallel spiral conduits.

The arrangement of spiral conduits ensures that the liquid will not leak whatever the properties of the liquid being delivered, even if the liquid has low viscosity or low surface tension.

Preferably, the outlet ports are recessed in an interior surface of the housing.

Air from the air inlet channel may enter the reservoir through an inlet port on the activation device, which is in fluid communication with the air inlet channel's outlet ports.

The outlet ports and inlet port on the activation device normally occupy respective planes, the plane occupied by the outlet ports being distal from a base of the housing relative to the plane occupied by the inlet port on the activation device. This ensures that any liquid which makes its way towards the outlet ports has a large volume to fill before it covers them. They are also well away from any liquid should the dispenser be inadvertently inverted after being left for a period on its side, for example. It is a further advantage if these outlet ports are partially protected, so that if the dispenser is inverted, liquid does not get easily channelled into them. Such protection may be afforded by ensuring that the outlet ports exit at right-angles to the main direction of movement of liquid when the dispenser is shaken, inverted or otherwise agitated.

A sealing mechanism may be provided between the reservoir and the housing to ensure that if the closure device fails, thereby allowing liquid to flow from the reservoir then the liquid is still prevented from leaking from the dispenser system.

The air inlet port can be elongated and expanded in certain sections so that one or more additional spill-over chambers are created (as with the single, mutual channel described above into which the parallel spiral conduits converge). For example, one chamber might be at the top of the dispenser and another at the bottom of the dispenser, such that air must pass consecutively through these chambers to enter the dispenser, and liquid must correspondingly find its way out through the chambers before the dispenser leaks. Thus, each set of parallel spiral conduits may terminate in one or more spill-over chambers, which forms part of the air inlet channel. Spill-over chambers can be voids or be filled with a foam, sponge or absorbent material which retains or partially retains any liquid which finds its way therein. The absorbent material could be a gel where the voids are created naturally in the material or an open-sintered ceramic which is inflexible Additional spill-over chambers provide additional protection and liquid containment, which is usually not required. However, where the level of abuse of the dispenser is anticipated to be high such additional containment of liquid is advantageous.

The outlet ports may be sited at or near the centre of any spill-over chamber with which they are in direct communication.

There now follows a description of various embodiments of the invention by way of example with reference to the accompanying drawings, in which:

FIG. 1 shows three views of one possible dispenser configuration which embodies this invention;

FIGS. 2*a* and 2*b* show views of a dispenser in the pre-activated state and the post-activated state respectively;

FIG. 3 shows two cut-away views of the housing including a foil cutter for a foil sealed rigid reservoir;

FIGS. 4*a* and 4*b* illustrate schematically cross-sectional views of a push-type valve seal for the reservoir;

FIGS. 5*a*, 5*b* and 5*c* illustrate schematically cross-sectional views of a rotational-type valve seal for the reservoir;

FIG. 6*a* shows a dispenser with a tear-away strip providing a mechanical obstruction to activation;

FIG. 6*b* shows the dispenser of FIG. 6*b* after removal of the tear-away strip and activation of the dispenser;

FIGS. 7*a*, 7*b*, 7*c* and 7*d* illustrate schematically the use of a removable clip to provide a mechanical obstruction to activation;

FIGS. 8*a* and 8*b* show two views of the housing of a dispenser embodying this invention, where by means of making the outer layer transparent one side of the air inlet path is visible;

Figure 1:
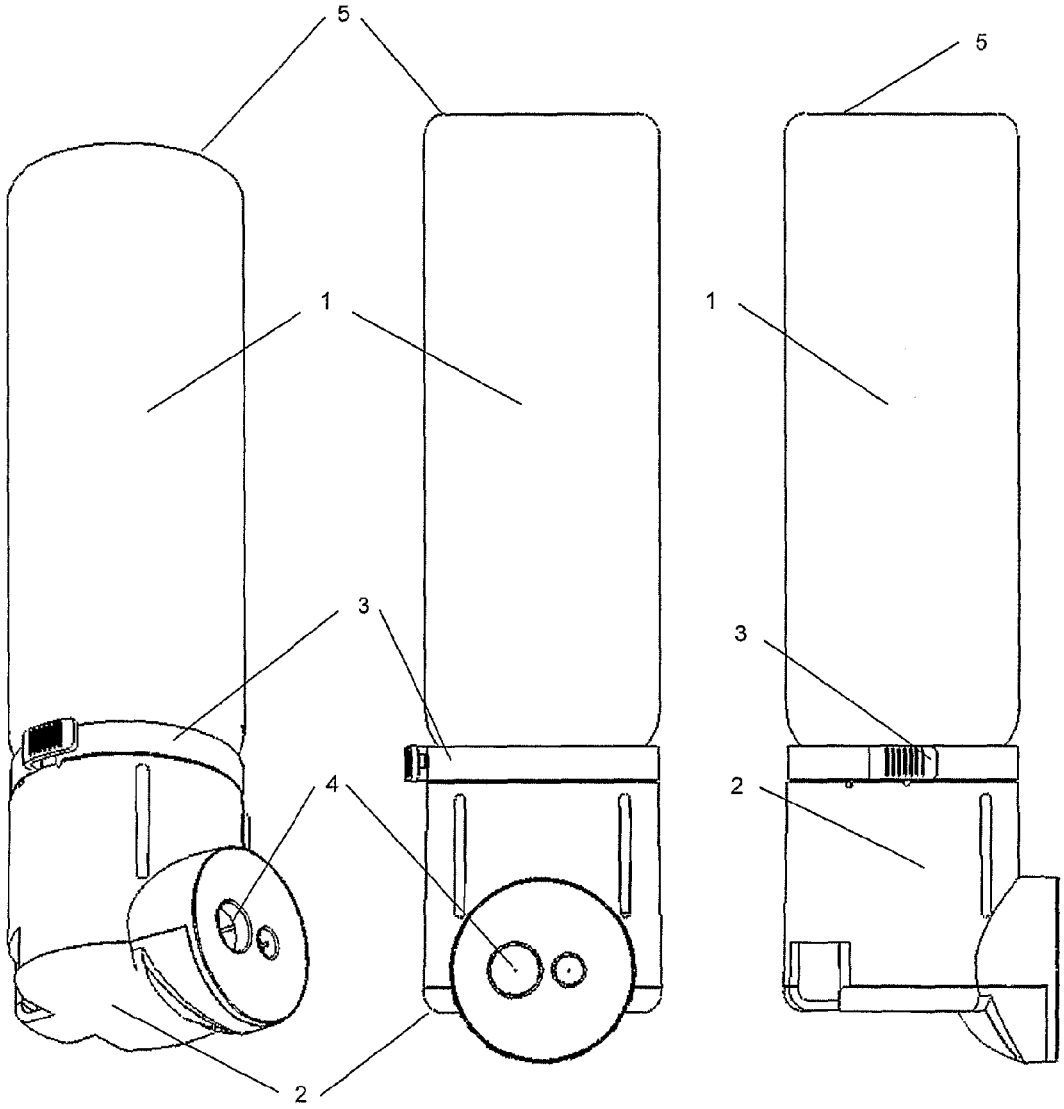

FIG. 1 shows various views of one possible dispenser embodying the present invention. The dispenser comprises a rigid reservoir 1 is connected to a housing 2. A tear-away strip 3 forms a mechanical obstruction to prevent premature or unintended activation of the unit. After activation the liquid is drawn under normal use from the reservoir through an outlet port 4, which in this case is a stainless steel capillary with an external diameter 400 μm.

The rigid reservoir has a hard shell 5 which contains the liquid and prevents any degradation or evaporation of the liquid. If the liquid is photosensitive the shell 5 may be opaque or contain an ultraviolet barrier. If the liquid is corrosive or chemically aggressive the shell may comprise any material which is suitable for its containment, provided only that it is rigid, or reinforced to make it rigid.

In normal use the dispenser is orientated so that the longitudinal axis of the reservoir 1 is vertical and the reservoir 1 is at the top; the housing 2 that contains the outlet port 4 is correspondingly at the bottom. This configuration is important as the dispenser is designed to provide liquid at a constant head of liquid pressure, and if the dispenser is aligned in an attitude which deviates significantly from this optimum position the pressure head will change.

The rigid reservoir has a closure device or seal at its lower end, which is situated inside the main body, and therefore not visible in FIG. 1. Once the dispenser is filled and assembled the seal ensures the liquid does not degrade or evaporate prior to use.

Figure 2A:
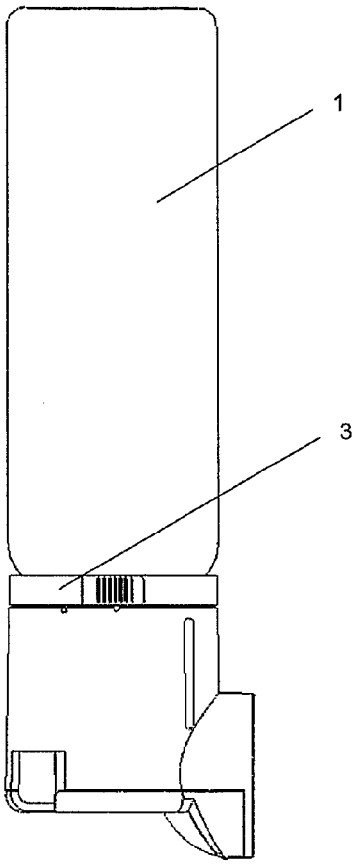
Figure 2B:
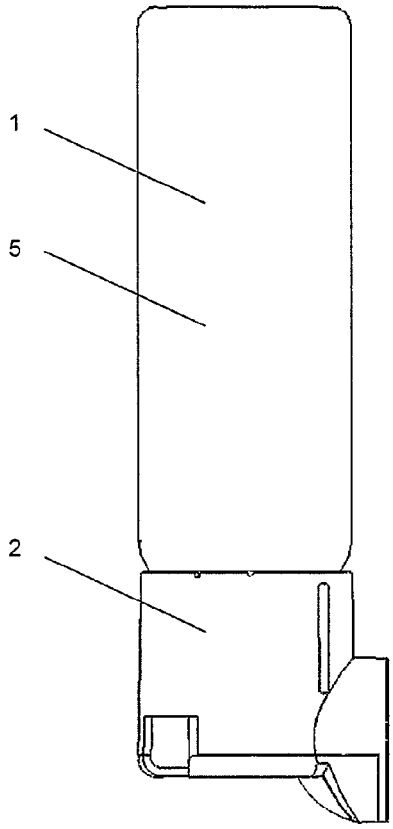

FIG. 2*a* shows the same dispenser in a pre-activated state, and FIG. 2*b* shows the dispenser in the post-activated state. The views are from the dispenser's side, and it is apparent that in FIG. 2*b* the tear-away strip 3 has been removed, and the rigid reservoir 5 pushed down into the housing 2. Inside the dispenser, a foil seal which prevents the liquid in the reservoir form degrading or evaporating between the time of manufacture and use, has been pierced by a special foil cutter (not visible in FIG. 2*b*) inside the housing 2. The foil cutter and tear-away strip 3 are just one possibility. Other possibilities, such as a removable clip to replace the tear-away strip 3, or a valve in the rigid reservoir instead of the foil seal are described below.

In normal use and when the dispenser is vertically orientated in the optimum position described above, the closure device or seal on the reservoir 1 is broken or released by means of a significant mechanical movement, that is relative motion between the reservoir 1 and housing 2. Once this has occurred, the reservoir 1 is held firmly within the housing 2, so the two provide a complete unit which cannot be dismantled except by a destructive force. The broken seal is held in the housing 2 of the dispenser at a fixed height above the outlet port 4, thus providing the constant head of pressure for the liquid feed.

Once the liquid is released through the closure device or seal on the reservoir 1 it becomes necessary to ensure that it cannot escape from the dispenser should the dispenser be moved or tilted to some non-ideal attitude. The first barrier to liquid escaping is a narrow air-bleed channel under the open end of the rigid reservoir. Liquid cannot escape from the dispenser system if air cannot enter, and so the dimensions of this channel are of capillary order such that air and liquid cannot pass one another. Therefore, by providing only a single narrow path for air to enter the reservoir 1, which is otherwise sealed, the liquid remains in the reservoir 1 because any liquid in the air-bleed channel effectively seals the reservoir unless the air pressure differential between the reservoir 1 and the environment increases for whatever reason.

Figure 3:
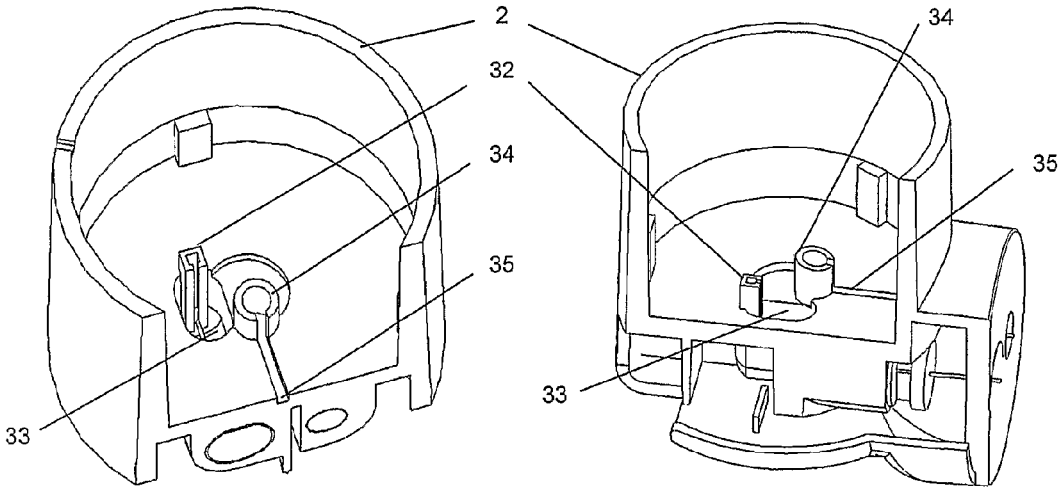

FIG. 3 shows two part cut-away views of the inside of the housing 2. An insert (that is used to seal the housing 2 to the reservoir 1) is normally fitted to the housing 2 but is not shown in FIG. 3 to improve clarity. In particular, FIG. 3 shows one possible foil cutter 32. The benefit of the design shown here is that the foil-sealed rigid reservoir 1 only needs to be activated by a simple push into the housing 2. It is obvious that a simple spike would also pierce the foil, but this would neither allow liquid to flow from the reservoir 1 nor allow air to flow in. So whilst the foil may have been pierced the liquid would not be available at the outlet port 4, and the dispenser although apparently activated would not function correctly. This could be overcome by an instruction to rotate the reservoir 1, thus scoring a line in the foil which might then release the liquid form the reservoir 1. However, we have found such methods to be unreliable unless carried out by trained and diligent personnel.

The liquid-channel foil cutter 32 illustrated in FIG. 3 uses two cutting points as can be seen. The liquid-channel foil cutter 32 is used to draw liquid out of the reservoir 1 and down into the well 33 towards the outlet port 4. An air-channel foil cutter 34 is used to pierce the foil closure device, thereby allowing-transfer of air into the rigid reservoir 1 through the foil, so that liquid can be correspondingly released. The dimensions of these two different foil cutters 32 and 34 are important. The liquid-channel foil cutter 32 has a capillary dimension so that it exploits surface tension forces to draw the liquid out of the reservoir 1 and down into the well 33. The air-channel cutter 34 has larger dimensions so that liquid is less likely to be drawn out. Instead air is free to travel up into the reservoir to replace any liquid in the liquid-channel cutter.

However, any liquid that does escape from the hole in the foil cut by the air-channel cutter 34 will simply collect in the well 33. Once liquid has been drawn down into the well 33, there are additional siphoning forces which maintain the flow of liquid down into the well 33 and air up into the reservoir.

Note that the air inlet channel 35 provides an air-bleed path into the reservoir 1 when the insert is in place. More explanation of this is given with respect to FIG. 10 below.

Figure 4A:
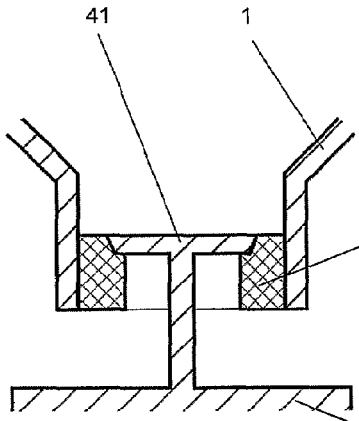
Figure 4B:
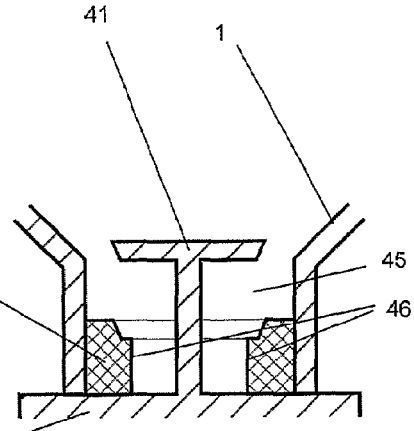

FIGS. 4*a* and 4*b* show two cross-sectional views of a push-type valve seal that is an alternative closure device to the foil seal described earlier. FIG. 4*a* shows the bottom of the reservoir 1 in the pre-activation state. The valve 41 is engaged with a valve seat 42, and is thus closed so that liquid is held permanently in the reservoir 1. In FIG. 4*b* the reservoir 43 has been activated by being pushed down into the base of the housing 2. This action opens up a gap 45 between the valve 41 and valve seat 42 so that liquid is free to pass into the well 33 and air into the reservoir 1 via one or more channels provided in the base of housing 2 (these channels are not shown in FIGS. 4*a* and 4*b* because they lie in a plane different to that shown in these cross-sections). Note that here the dimensions of the gap 45 are large, so that the liquid meniscus will become unstable and the liquid/air exchange can take place. This action can be enhanced by providing narrow channels of capillary dimensions in the side walls 46 below the valve 41 to help initiate the flow of liquid out of the reservoir 1.

Figure 5A:
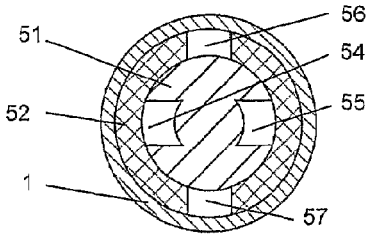
Figure 5B:
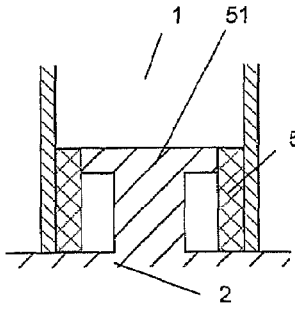
Figure 5C:
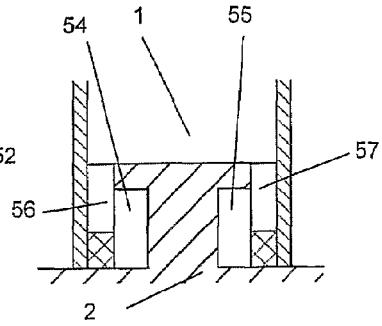

FIGS. 5*a*, 5*b* and 5*c* show cross-sectional illustrations of a rotating-type valve seal for a rigid reservoir. FIG. 5*a* is a section through the axis of the valve, where a central spindle 51 fits snugly inside a cap 52 fitted to the reservoir 1. The cap 52 and the reservoir 1 are attached to one another so that they are mechanically fixed. Two paths 54 and 55 are provided in the spindle 51, and two paths 56 and 57 are provided in the cap 52. Although FIGS. 5*a* to 5*c* show two paths in the spindle 51 and cap 52, it is clearly possible to use a different number in each of these parts. However, if the paths are spaced symmetrically about the longitudinal axis of the dispenser, the reservoir 1 and housing 2 can be rotated in either direction and the more paths that are provided the smaller the required angle of rotation to open the valve.

FIG. 5*b* shows a vertical section of the same valve configuration which runs along the longitudinal axis of the valve. Notice that the spindle 51 is in fixed mechanical communication with the base of the housing 2, which allows the reservoir 1 to be activated by rotating the reservoir 1 relative to the housing 2. Note that in this position the reservoir 1 remains sealed because the top of the spindle 51 provides a continuous seal with the reservoir cap 52 the liquid/air paths being below this section.

FIG. 5*c* shows the same arrangement when the reservoir and cap have been rotated through 90 degrees relative to the main body and spindle. When this has happened the paths 54 and 55 line up with paths 56 and 57 respectively, and thereby form two continuous conduits from the reservoir 1 to the base of the housing 2. From here the liquid may pass freely into the well 33 in the housing 2 and air may pass via the air-bleed channel up into the reservoir 1 via one or more channels provided in the base of housing 2 (these channels are not shown in FIGS. 4*a* and 4*b* because they lie in a plane different to that shown in these cross-sections).

It may be advantageous to have some features of capillary dimension moulded into the side walls on one of the pairs of paths 54 and 54 or 55 and 57, so that liquid is more likely to pass down that pair of paths, leaving air to pass up the other pair. However, if the dimensions of the conduits are sufficiently large, the natural instability of the liquid meniscus may be sufficient to initiate the movement of liquid out of the rigid reservoir 1.

Note further that the spindle 51 and housing 2 do not have to be fixed to each other, but could instead be connected by a 'key' (i.e. a feature in the housing which engages with the spindle 51) which allowed the reservoir 1 to be assembled easily into the housing 2, but would then transfer the necessary torsion force between the housing 2 and spindle 51 for correct functioning of the valve.

FIG. 6*a* shows a view of the tear-away strip 3 which is used to provide a mechanical obstruction to the activation of a foil or push-type valve closure device or seal of the reservoir 1. The tear-away strip 3 is provided by a piece of plastic which although mechanically connected to the rest of the housing 2, is only materially connected at a plurality of points of weak plastic. Together these points provide sufficient strength to hold the reservoir 1 away from the housing 2, but when broken one at a time by pulling on the tab provided, they tear and the strip 3 is removed as shown in FIG. 6*b*. In FIG. 6*b* the reservoir 1 has also been activated by pushing it into the housing 2 so as to cause the closure device to open and allow liquid to flow from the reservoir 1.

FIGS. 7*a* and 7*b* show an illustration of another mechanical obstruction means to prevent early activation of the dispenser. In this case a flexible plastic clip 71 is provided, which fits and snaps snugly around the neck of the rigid reservoir 1. This therefore provides a good mechanical obstruction to prevent the reservoir 1 from being activated inadvertently by being pushed into the housing 2. When the dispenser is ready to be activated the clip 71 is pulled out to the side by the finger tab 74 as illustrated in FIG. 7*b*. The reservoir 1 is then free to be pushed towards the housing 2 into its post-activated state.

Note that with this configuration there is a possibility to return the dispenser to the pre-activated state if a push-type valve seal is being used, although a rotating-type valve seal may be preferential as this does not affect the volume of the reservoir, and so is less likely to create unwanted displacement of liquid out of the dispenser.

Figure 7C:
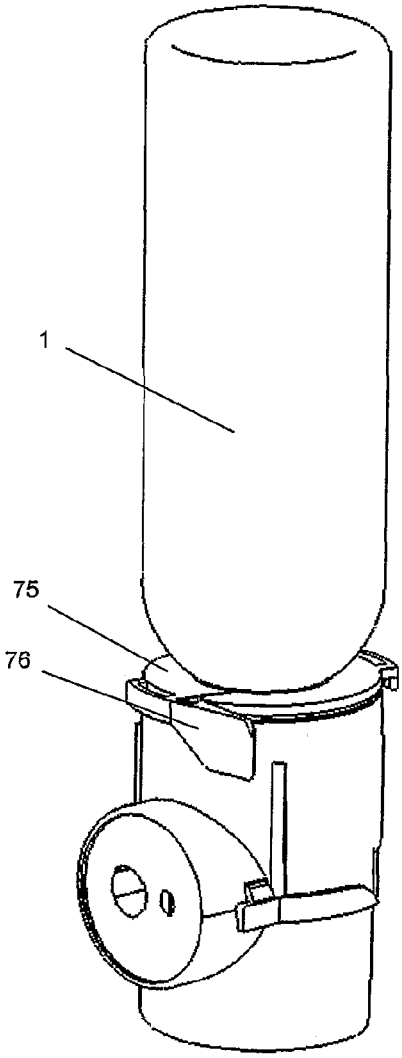
Figure 7D:
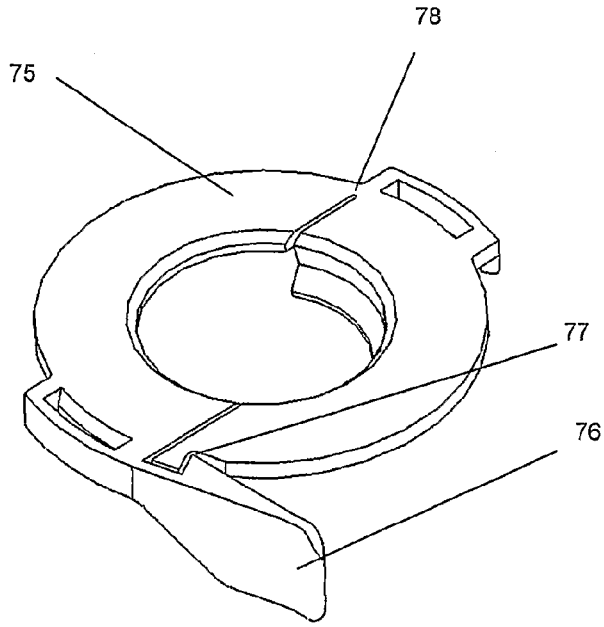

FIGS. 7*c* and 7*d* show an illustration of another mechanical obstruction means to prevent early activation of a dispenser embodying this invention. In this case a hinged plastic clip 75, (shown separately in FIG. 7*d*), is provided which fits snugly around the neck of rigid reservoir 1, thus preventing the dispenser from being activated inadvertently. The dispenser is activated by pulling on the tab 76, snapping the weak plastic joint 77 and rotating the obstruction clip 75 about the natural hinge 78, and out of the dispenser, so that the rigid reservoir 1 can be pushed towards the housing 2 into its activated position.

Figure 8A:
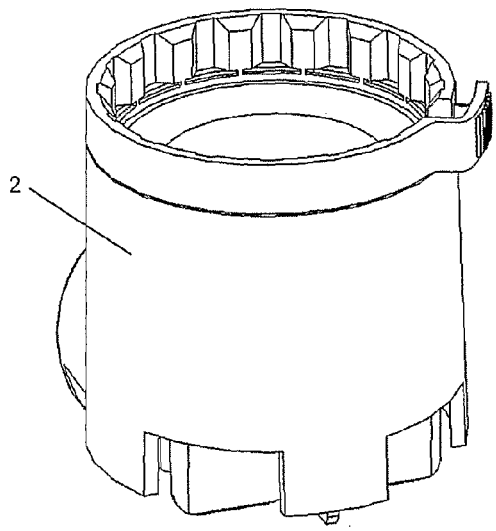
Figure 8B:
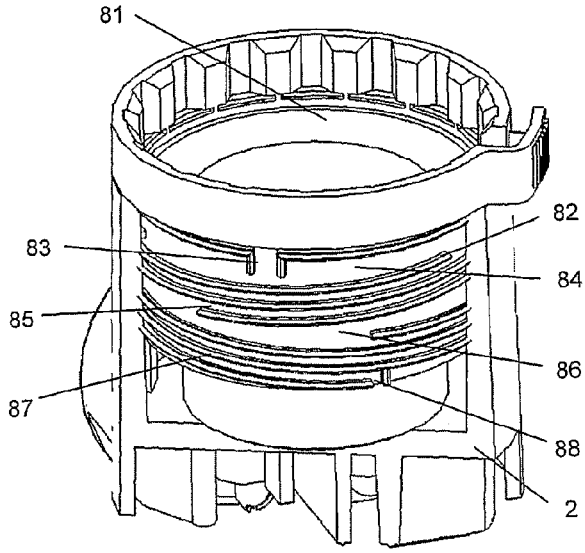

FIGS. 8*a* and 8*b* show two views of the housing 2. In FIG. 8*b* the housing 2 has been made transparent so that the internal structure of the insert 81 can be seen. The air-inlet channels are created by the gaps between the housing 2 and the insert 81, and in particular the path of each channel is defined by features (such as shown into 82) moulded into the insert 81. These features 82 press against and more preferably are welded to the housing 2 so that liquid cannot pass between the housing 2 and insert 81 except via the channels defined by the features 82. This forms a convenient means of creating complicated conduits for the air into (and out of) the dispenser. For instance, here it is possible to see the spiral air-inlet channels which form an important part of this invention.

In normal use, in other words once the dispenser has been activated, air is able to enter the dispenser via the air-inlet port 83. This communicates with a continuous channel 84 which runs around the periphery of the housing 2. Channel 84 splits into three separate spiral conduits (one of which is shown by reference numeral 85) each following a clockwise helical path around the internal walls of the housing 2.

Each spiral conduit 85 shown here rotates by 240 degrees around the longitudinal axis of the dispenser, so that if the dispenser is left activated and lying on its side liquid is unable to pass out of the dispenser should the air pressure inside increase relative to the ambient environment. This is something that might happen if the temperature of the air in the dispenser rises, or if the dispenser is moved to an area of lower pressure such as in the cabin of an aircraft or it is taken to a higher altitude.

Below the first set of spirals, the air-inlet channel joins again into a single channel 86, which runs around the entire periphery of the housing 2. The air-inlet channel then splits again into three helical paths (one of which is shown by the reference numeral 87), this time rotating in the opposite sense or anti-clockwise as illustrated here.

Finally the air-inlet path communicates with the inside of the dispenser through three ports, of which only one 88 is visible from this viewing angle. The others are identical but symmetrically spaced around the axis of the dispenser.

Note that the exit ports (88, for example) are recessed into the inside wall of the housing 2. However, this is best seen in FIG. 10.

Note that the sense (clockwise or anti-clockwise) of the spiral conduits is not critical, but it is beneficial if each set counter-rotates with respect to those above and below it. Also, the number of sets of spirals is not important, but the higher the number, the better the protection against leakage. It is further advantageous if each set describes a minimum angle around the axis of the dispenser of $180\times(n+1)/n$ degrees, where n is the number of separate spirals in each set, and also if the size of the air-inlet paths are of capillary dimensions so the liquid cannot be drawn along the conduits due to surface tension forces alone. This reasoning effectively limits the number of spiral sets depending on the overall size of the dispenser system.

Figure 9:
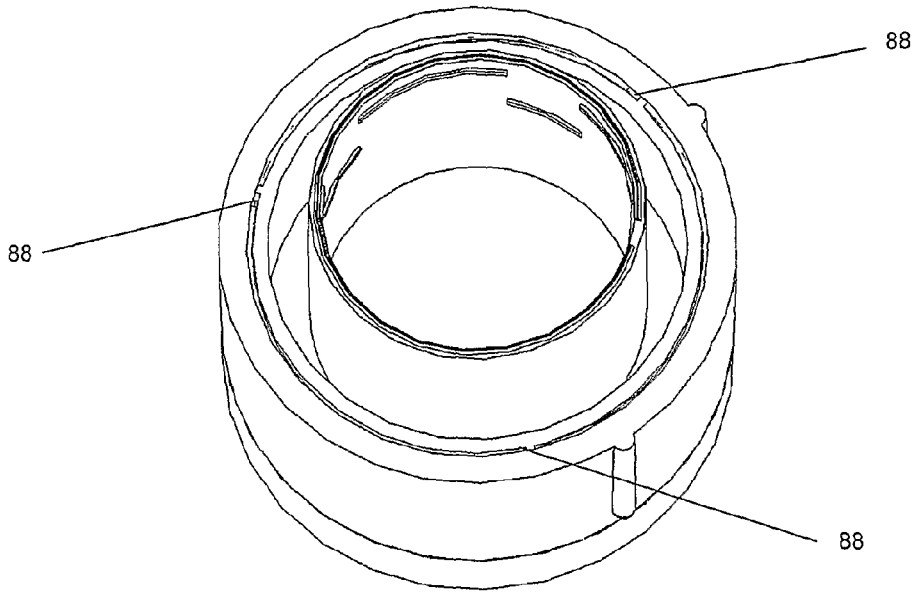
FIG. 9 shows the symmetrically spaced starting points for three parallel spiral air inlet channels.

FIG. 9 shows a cross-sectional view of the dispenser at the height of the outlet ports of the air-inlet channels. The view looks at an angle from the bottom of the dispenser (as defined under the optimum operating conditions). The three ports are referred to by numerals 88. Note that these are symmetrically spaced around the longitudinal axis of the dispenser. Although this symmetry is not vital, it does make the design more simple, as each spiral can then be identical but rotated through the respective angles to create the required symmetry.

Figure 10:
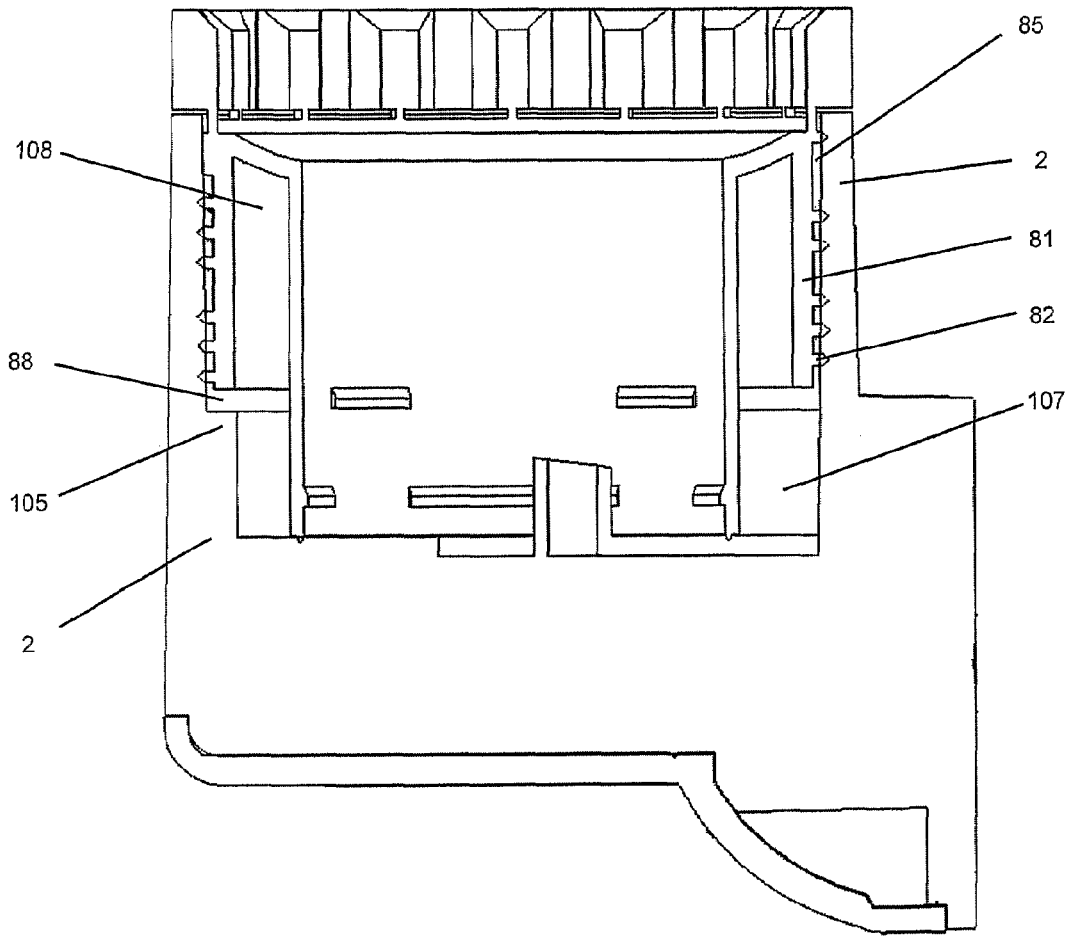
FIG. 10 shows a cross-sectional view of part of a dispenser embodying this invention, which highlights the protective feature around the inner end of one spiral air inlet path.

FIG. 10 shows a cross-sectional view along the axis of a dispenser as embodied in this invention, where the reservoir and sealing parts are not shown for clarity. Here it is possible to see the air-inlet conduits such as 85, which are formed between the housing 2 and the insert 81, and delimited by the features such as indicated by 82.

One outlet port 88 is visible in this section, and here it is clear to see how the protection against liquid movement is created by the step 105 which forms a recess within which the outlet port 88 is situated. The step 105 extends from the base of the housing 2 towards the outlet port 88 as can be seen. If liquid should pass out of the rigid reservoir 1 into the cavity 107 within housing 2 and insert 81 and the dispenser is inadvertently inverted, the liquid therein will run down the walls but it will not run into the outlet ports 88. Instead, it will travel past the outlet port into the top 108 of the cavity 107. This is why the outlets ports 88 are situated roughly half way up the housing 2.

Figure 11:
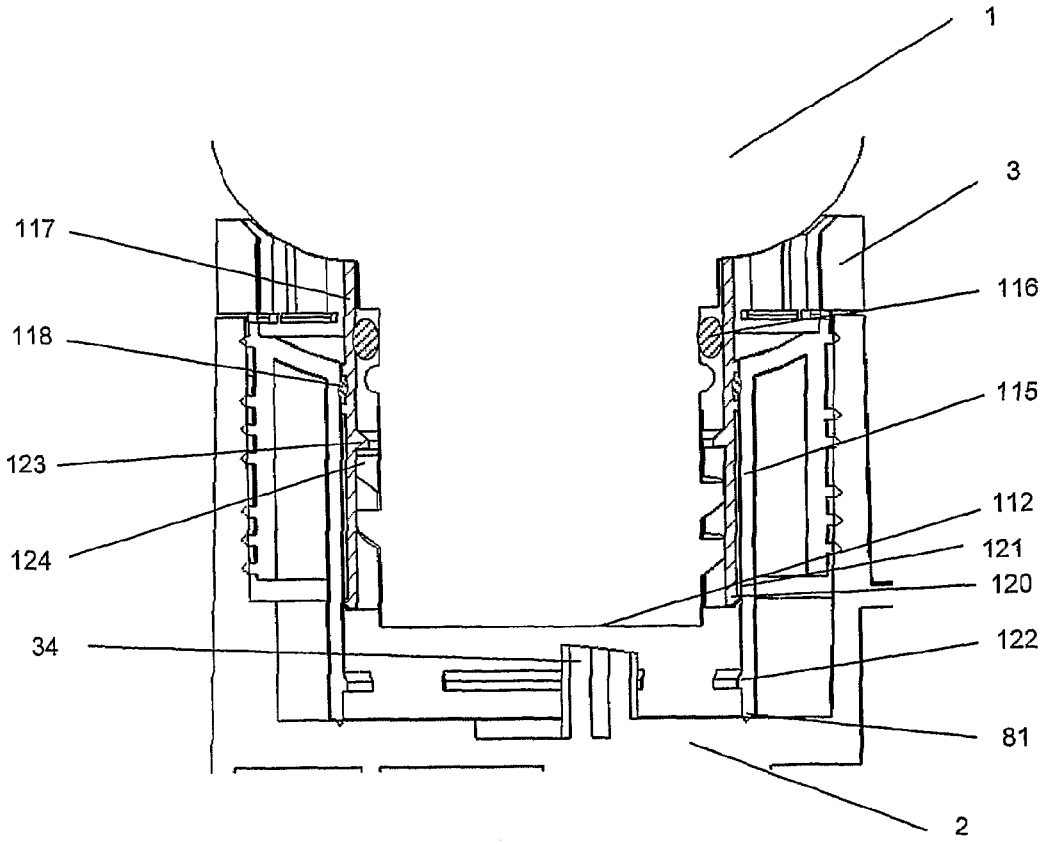
FIG. 11 shows a part cross-sectional view of an example of one possible dispenser configuration embodying this invention highlighting a seal mechanism for a dispenser in the pre-activated state.

FIG. 11 is a part cross-sectional view of the dispenser, showing the reservoir 1 in the pre-activated state, where it is held away from the housing 2 by the mechanical obstruction of the tear-away strip 3. In this example the reservoir 1 is sealed by a heat welded foil 112 across the end of the reservoir 1.

FIG. 11 shows where the bottom of the insert 81 is sealed against the housing 2 by an ultrasonic weld or glue along the mutual contact ridge, so that the only way air can enter the reservoir 1 is via the air-bleed channel 35 which is not visible in this section but is shown in FIG. 3, and passes under the bottom of the insert 81.

Here is it also possible to see the way a seal between the reservoir 1 and the insert 81 is maintained even in the pre-activated state shown here. One O-ring 116 passes all the way round the outside of the neck of the reservoir 1 to seal it against the cylindrical plastic collar 117. This collar 117 in turn is then sealed against the insert 81 by another O-ring 118.

When the tear-away strip 3 is removed the reservoir 1 and collar 117 are free to move down into the housing 2, and the O-ring 118 slides down the inside of the insert 81 maintaining a seal for liquid all the time. Once the reservoir 1 and collar 117 are pushed all the way down the foil 112 is breached by the cutters 32 and 34, one of which is visible in this section, and the transfer of liquid out of the reservoir 1 may begin. The dispenser then maintains a constant head of pressure on the outlet port 4 as determined by the vertical distance between the internal base of the housing 2 and the outlet port 4.

A two stage-latching system is provided by the edge of the collar 120 and the catches 121 and 122. The reservoir itself is held into the collar by the annular latch 123 which butts up against a catch or thread on the neck of the reservoir 124. In this way the whole dispenser forms a strong unit which cannot be dismantled without destructive force.

FIG. 12 *a, b, c* and *d* show various views of another possible dispenser embodying the present invention. Here the electrode housing has been assembled by welding together a front part 131 to a back part 132. The rigid reservoir is provided by means of a bottle 133, which is normally housed inside a cap 134 so that the reservoir 133 is protected from tampering.

Figure 12A:
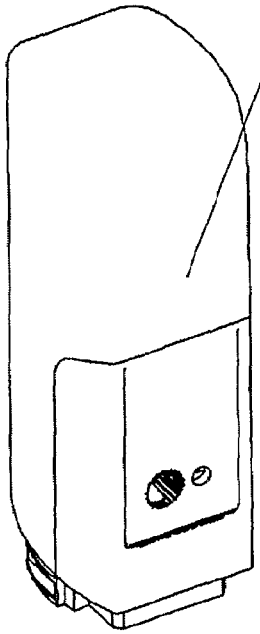
FIG. 12 shows another embodiment of the invention.
Figure 12B:
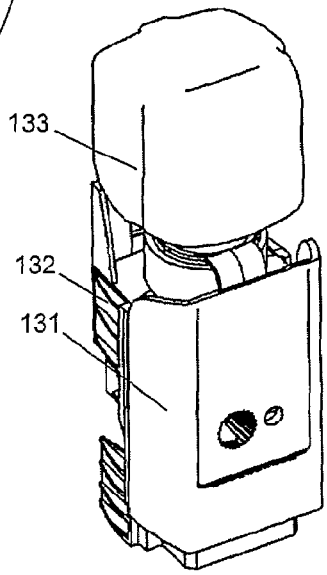
Figure 12C:
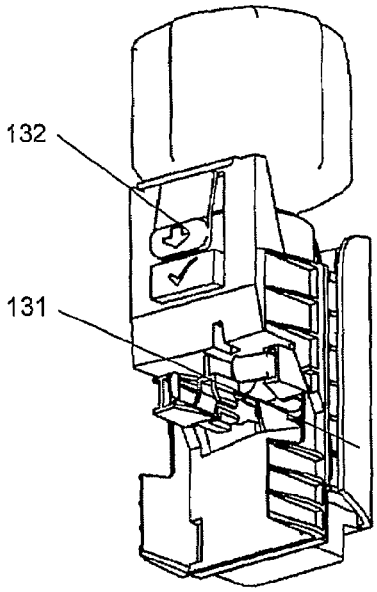
Figure 12D:
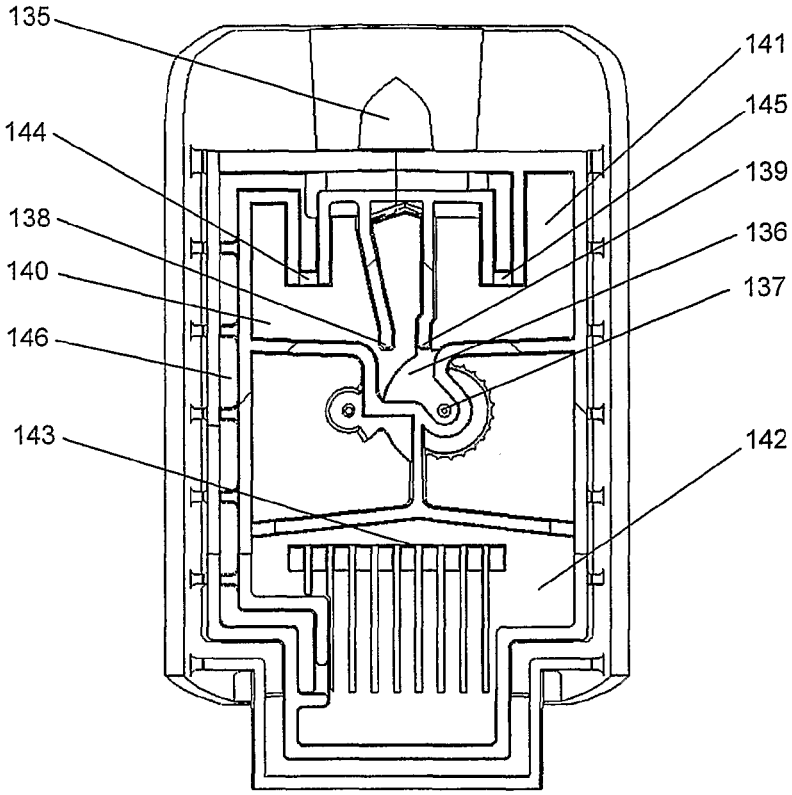

Most of the important features of this embodiment are best illustrated by the inside view of the front part 131, which is shown in FIG. 12*d*. Note that the back part 132 may be considered to be a mirror image of this part in respect of the dividing walls, such that the walls may be considered to be closed off by the back part. In this FIG. 12*d* the bottle 133 is not shown, but it is possible to see the spike 135 which pierces the foil seal of the bottle when the dispenser is activated.

Once the dispenser is activated liquid flows down the internal channel of the spike 135 into the electrode well 136, where the liquid exits from the dispenser through the exit port 137. As liquid is drawn off through the outlet port 137 air bubbles pass under the walls 138 and 139, from where they rise up through the spike 135 and into the bottle, thus maintaining a constant head of pressure equal to the vertical height distance from the points 138 and 139 down to the exit port 137. Air is provided for via a series of spill-over chambers 140, 141 and 142, and ultimately enters the dispenser through the inlet port 143 in the lower spill-over chamber 142.

If the dispenser is inverted or orientated in any aspect other than the vertical, liquid may migrate from the electrode well 136 into the first containment chamber which is split into two halves 140 and 141. Air enters the chamber 140 via inlet hole 144, and enters chamber 141 via inlet hole 145. Both of these inlet holes 144 and 145 are situated as close as possible to the mid points of chambers 140 and 141 respectively, so that the probability of liquid leaking out of these inlet holes is minimised when the dispenser is orientated in a position other than the vertical by virtue of the liquid running past the inlet holes and into the remainder of the respective chamber.

In the unlikely event that liquid does find its way out of the air inlet holes 144 and 145, it will migrate down the communication channel 146 which connects the upper spill-over chambers 140 and 141 with the lower chamber 142. Liquid entering the lower chamber 142 is normally mopped up by a sponge or other porous absorbent material which is not shown here for clarity, but which fills the lower chamber 142. This chamber therefore provides extra protection against leakage for the dispenser.

The invention claimed is:

1. A dispenser system comprising a reservoir, a closure device for controlling a flow of liquid from the reservoir, and a housing comprised of an exterior surface, the housing being attached to the reservoir the reservoir being movable relative to the housing from a storage position, in which the closure device prevents the liquid from flowing from the reservoir, to a dispensing position, in which the closure device allows the liquid to flow from the reservoir, wherein the housing comprises an activation device which on movement of the reservoir from the storage position to the dispensing position causes the closure device to allow the liquid to flow from the reservoir, wherein the housing further comprises an inlet air channel through which air can flow from one or more inlet ports on the exterior of the housing to one or more outlet ports within the housing so as to displace any liquid that flows from the reservoir, wherein the air inlet channel splits into a number of sets of one or more parallel spiral conduits arranged around the periphery of the housing.

2. A dispenser system according to claim 1, wherein the reservoir is rotationally movable relative to the housing from the storage position to the dispensing position.

3. A dispenser system according to claim 1, wherein the reservoir is linearly movable relative to the housing from the storage position to the dispensing position.

4. A dispenser system according to claim 1, wherein the closure device is a membrane that is ruptured by the activation device when the reservoir is moved to the dispensing position, thereby allowing liquid to flow from the reservoir.

5. A dispenser system according to claim 1, wherein the closure device is a valve that is opened by the activation device when the reservoir is moved to the dispensing position, thereby allowing liquid to flow from the reservoir.

6. A dispenser system according to claim 5 wherein movement of the reservoir from the dispensing position to the storage position causes the valve to close, thereby preventing liquid from flowing from the reservoir.

7. A dispenser system according to any of the preceding claims, further comprising a removable activation inhibitor which prevents the reservoir being moved from the storage position to the dispensing position.

8. A dispenser system according to claim 7, wherein the activation inhibitor is attached to the housing by way of one or more anchor sections that yield when the activation inhibitor is pulled from the housing.

9. A dispenser system according to claim 8, wherein the activation inhibitor is integrally moulded with the housing.

10. A dispenser system according to claim 7 wherein the activation inhibitor is a plastic strip disposed between the reservoir and housing.

11. A dispenser system according to claim 7 wherein the activation inhibitor is replaceable after it has been removed from the housing.

12. A dispenser system according to claim 11, wherein the activation inhibitor is a flexible clip that is disposed between the reservoir and the housing.

13. A dispenser system according to claim 2, wherein the closure device is a membrane that is ruptured by the activation device when the reservoir is moved to the dispensing position, thereby allowing liquid to flow from the reservoir.

14. A dispenser system according to claim 3, wherein the closure device is a membrane that is ruptured by the activation device when the reservoir is moved to the dispensing position, thereby allowing liquid to flow from the reservoir.

15. A dispenser system according to claim 2, wherein the closure device is a valve that is opened by the activation device when the reservoir is moved to the dispensing position, thereby allowing liquid to flow from the reservoir.

16. A dispenser system according to claim 15, wherein movement of the reservoir from the dispensing position to the storage position causes the valve to close, thereby preventing liquid from flowing from the reservoir.

17. A dispenser system according to claim 3, wherein the closure device is a valve that is opened by the activation device when the reservoir is moved to the dispensing position, thereby allowing liquid to flow from the reservoir.

18. A dispenser system according to claim 17 wherein movement of the reservoir from the dispensing position to the storage position causes the valve to close, thereby preventing liquid from flowing from the reservoir.

19. A dispenser system according to claim 9 wherein the activation inhibitor is a plastic strip disposed between the reservoir and housing.

20. A dispenser system according to claim 8 wherein the activation inhibitor is replaceable after it has been removed from the housing.

21. A dispenser system according to claim 9 wherein the activation inhibitor is replaceable after it has been removed from the housing.

22. A dispenser system comprising a reservoir, a closure device for controlling a flow of liquid from the reservoir, and a housing comprised of an exterior surface, the housing being attached to the reservoir the reservoir being movable relative to the housing from a storage position, in which the closure device prevents the liquid from flowing from the reservoir, to a dispensing position, in which the closure device allows the liquid to flow from the reservoir, wherein the housing comprises an activation device which on movement of the reservoir from the storage position to the dispensing position causes the closure device to allow the liquid to flow from the reservoir, wherein the housing further comprises an inlet air channel through which air can flow from one or more inlet ports on the exterior of the housing to one or more outlet ports within the housing so as to displace any liquid that flows from the reservoir, wherein the air inlet channel splits into a number of sets of one or more parallel spiral conduits arranged around the periphery of the housing, wherein at least one of the adjacent set of parallel spiral conduits are arranged around the housing in opposing rotational senses.

23. A dispenser system according to claim 22, wherein each set of parallel spiral conduits comprises n conduits, and each of the n conduits is disposed so as to be rotationally symmetrical about a longitudinal axis of the housing and to extend between the ends of an arc of 180.times.(2n−1)/n degrees.

24. A dispenser system according to claim 22, wherein each set of parallel spiral conduits is formed between an interior wall of the housing and an insert fixed to the housing which defines the path of parallel spiral conduits.

25. A dispenser system according to claim 22 wherein each set of spiral conduits terminates in one or more spill-over chambers.

26. A dispenser system according to claim 25, wherein one or more spill-over chambers is filled with a foam, sponge or absorbent material.

27. A dispenser system according to claim 26, wherein the absorbent material is a gel or an open-sintered ceramic.

28. A dispenser system according to any of claims 22 to 27, wherein the outlet ports are recessed in an interior surface of the housing.

29. A dispenser system according to any of claims 25 to 27, wherein the outlet ports are sited at or near the centre of any spill-over chamber with which they are in direct communication.

30. A dispenser system according to any of claims 22 to 27, wherein air from the air inlet channel enters the reservoir through an inlet port on the activation device, which is in fluid communication with the air inlet channel's outlet ports.

31. A dispenser system according to claim 28 wherein air from the air inlet channel enters the reservoir through an inlet port on the activation device, which is in fluid communication with the air inlet channel's outlet ports.

32. A dispenser system according to claim 29, wherein air from the air inlet channel enters the reservoir through an inlet port on the activation device, which is in fluid communication with the air inlet channel's outlet ports.

33. A dispenser system according to claim 8 wherein the activation inhibitor is a plastic strip disposed between the reservoir and housing.

* * * * *